US006905705B2

(12) United States Patent
Palm et al.

(10) Patent No.: US 6,905,705 B2
(45) Date of Patent: Jun. 14, 2005

(54) MULTIPACK FOR REMOVING FILLED BAGS IN A PREDETERMINED SEQUENCE

(75) Inventors: Detlef Palm, Ochtendung (DE); Ronald Hackbarth, Bad Ems (DE); Michael Heberle, Hillscheid (DE); Detlev Neuland, Nickenich (DE)

(73) Assignee: LTS Lohmann Therapie Systeme AG, Andernach (DE)

( * ) Notice: Subject to any disclaimer, the term of this patent is extended or adjusted under 35 U.S.C. 154(b) by 65 days.

(21) Appl. No.: 10/824,988

(22) Filed: Apr. 15, 2004

(65) Prior Publication Data

US 2004/0232028 A1 Nov. 25, 2004

Related U.S. Application Data

(62) Division of application No. 09/936,545, filed as application No. PCT/EP00/02043 on Mar. 9, 2000.

(30) Foreign Application Priority Data

Mar. 17, 1999 (DE) ..... 199 11 799

(51) Int. Cl.[7] ..... A61K 9/00; A61K 9/70; A61K 31/56; A61K 31/565; B65D 77/00

(52) U.S. Cl. ..... 424/449; 424/400; 424/443; 424/447; 514/169; 514/170; 206/472; 206/438; 206/460; 206/461; 206/464; 206/466; 206/474

(58) Field of Search ..... 424/400, 443, 424/447, 449; 514/169, 170; 206/472, 438, 460, 461, 464, 466, 474

(56) References Cited

U.S. PATENT DOCUMENTS

| | | | | |
|---|---|---|---|---|
| 2,715,493 A | | 8/1955 | Vogt | |
| 3,915,302 A | | 10/1975 | Farrelly et al. | |
| 4,502,599 A | | 3/1985 | Perecman | |
| 5,422,119 A | * | 6/1995 | Casper | 424/449 |
| 5,686,112 A | | 11/1997 | Liedtke | |

FOREIGN PATENT DOCUMENTS

| | | | | |
|---|---|---|---|---|
| CH | 339119 | | 5/1959 | |
| DE | 1683678 | | 8/1954 | |
| DE | 16 83 678 | U1 | 8/1954 | |
| DE | 1027844 | | 4/1958 | |
| DE | 10 27 844 | | 9/1958 | |
| DE | 18 23 247 | U1 | 12/1960 | |
| DE | 1823247 | | 12/1960 | |
| DE | 88 11 648 | U1 | 11/1988 | |
| DE | 88 11 6484.4 | | 12/1988 | |
| DE | 42 23 004 | A1 | 1/1994 | |
| DE | 44 40 727 | | 5/1996 | |
| DE | 44 40 727 | A1 | 5/1996 | |
| EP | 0 409 383 | A2 | 1/1991 | |
| FR | 2180313 | | 11/1978 | |
| FR | 2629797 | A * | 10/1989 | B65D/71/00 |
| FR | 2629797 | | 10/1989 | |
| GB | 447 712 | | 5/1936 | |
| GB | 15 74 347 | | 9/1980 | |

* cited by examiner

*Primary Examiner*—Thurman K. Page
*Assistant Examiner*—Simon J. Oh
(74) *Attorney, Agent, or Firm*—Frommer Lawrence & Haug LLP

(57) ABSTRACT

This invention provides for, inter alia, a multipack comprising at least two different bags, wherein the bags are arranged in a predetermined sequence and are joined together in a single block. The inventive multipacks provide for, for example, a simplified method for the transdermal administration of therapeutic agents such as hormones to a patient in need thereof.

8 Claims, 4 Drawing Sheets

Figure 1: Multipack with simple backing
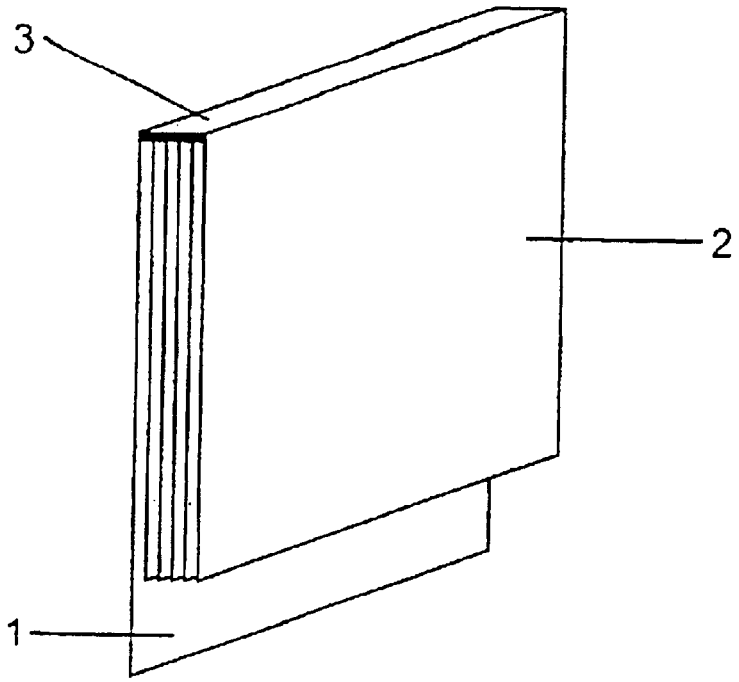
Figure 2: Multipack with cover
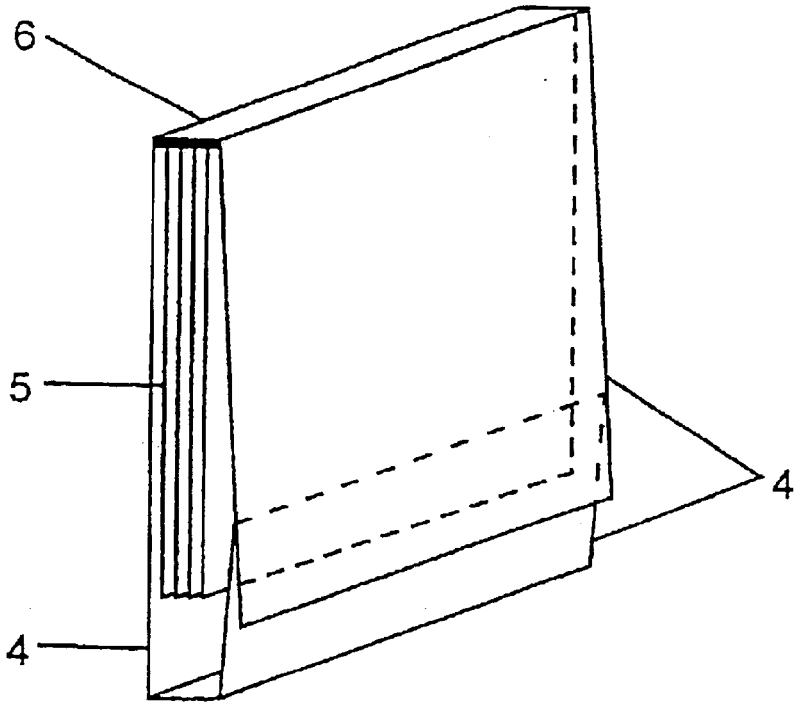

Figure 3: Multipack with cover opened
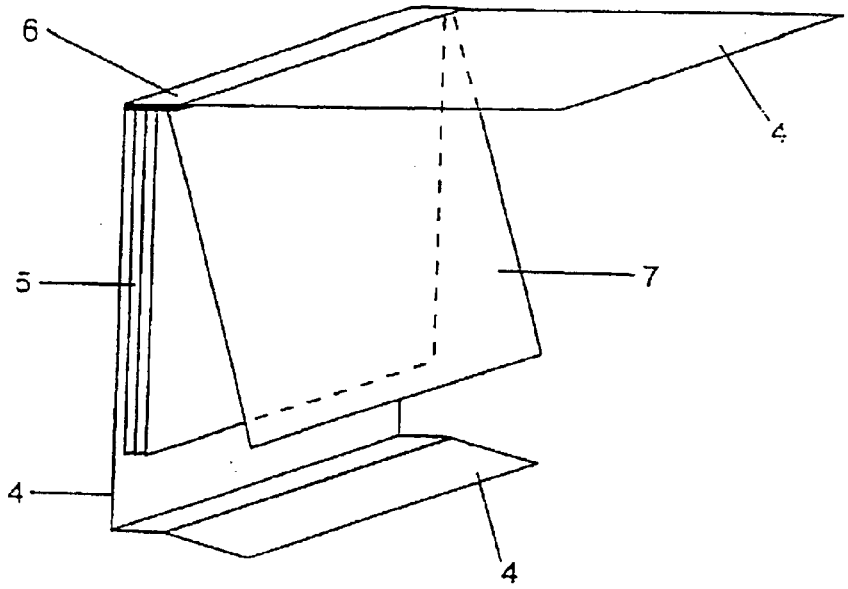
Figure 4: Multipack with backing and perforated edge
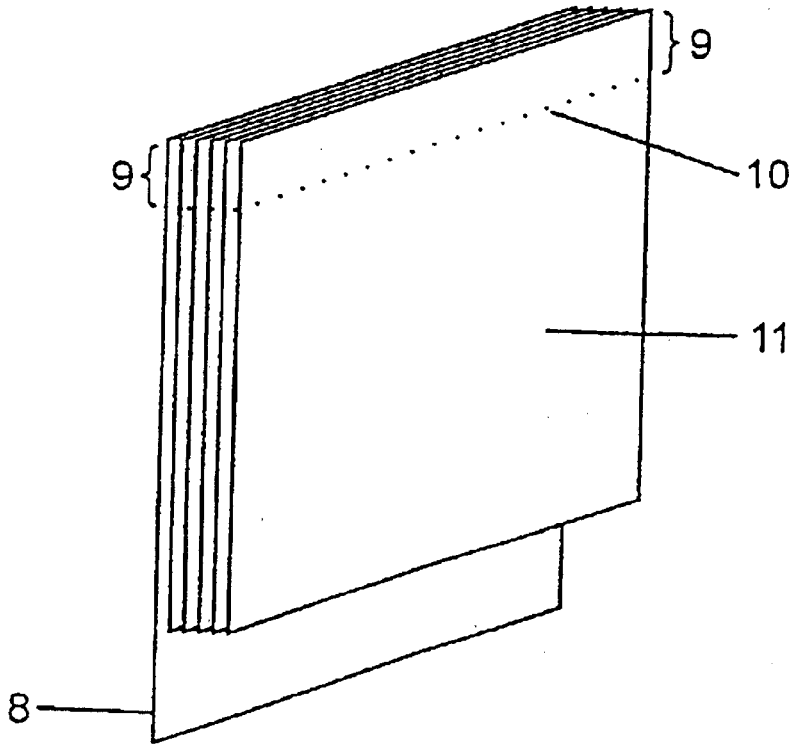

Figure 5: Multipack with backing and perforated edge, after two bags have been removed
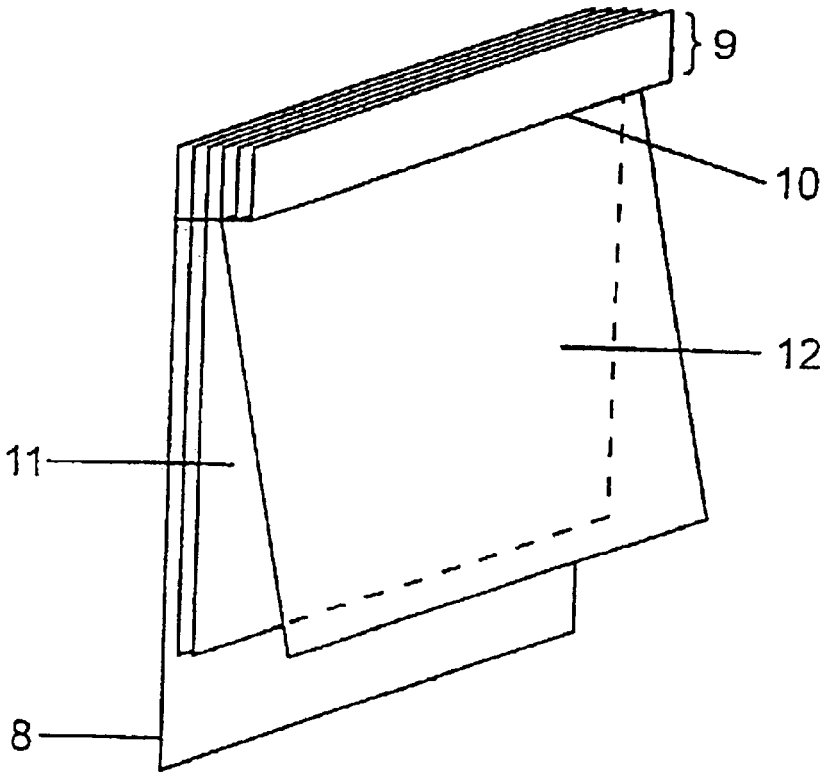

Figure 6: Multipack with spacers (13) between the superposed sections of the edges (9) of adjacent bags (5)
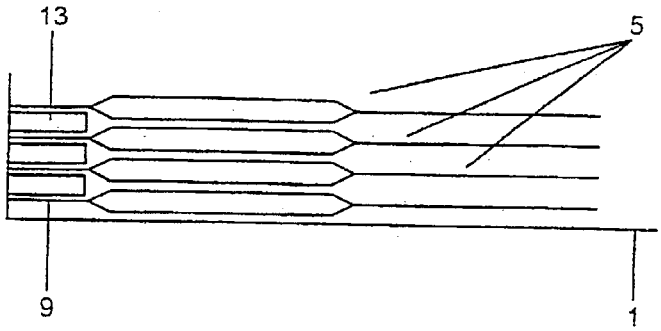
Figure 7: Multipack with margins of the edges (9) offset in parallel
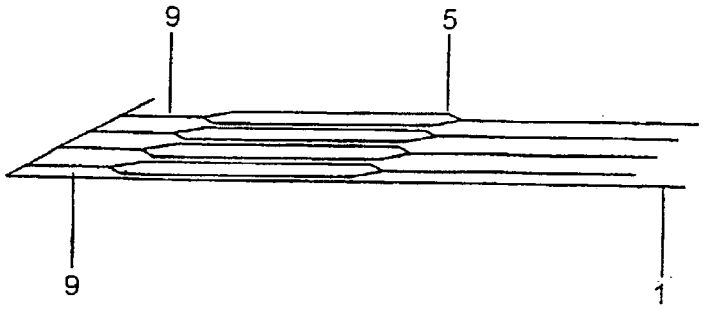

MULTIPACK FOR REMOVING FILLED BAGS IN A PREDETERMINED SEQUENCE

RELATED APPLICATIONS

This application is a divisional of application U.S. Ser. No. 09/936,545, filed on Sep. 14, 2001, now allowed, and herein incorporated by reference, which in turn is a 371 of PCT/EP00/02043, filed on Mar. 9, 2000, which in turn claims priority to German application Serial No. 19 911 799.3, filed Mar. 17, 999.

The invention relates to a pack of products which are packed for protection in a bag, the pack consisting of at least two bags. The contents (products) present in these bags can be identical or different. These contents are preferably to be removed and used in a predetermined sequence. These bags are of the type which have an inner area and an edge enclosing this inner area, for example rectangular sealed bags known to the person skilled in the art. Of course, these bags can also be sealed on only two or three edges or on one edge.

The products concerned are preferably planar systems, for example stickers, labels, tissue wipes, diskettes, CD-ROMs, chip cards, coins, postage stamps, planar systems for oral or transdermal application or plasters and the like. In a particular embodiment, the products concerned are identical and/or different hormone plasters (transdermal therapy systems with sex hormones). These plasters can be used, for example, in the context of hormone replacement therapy, where, in a first phase (duration about 14 days), a plaster containing an estrogen is applied every third day and, in a second phase (duration about 14 days), a plaster containing an estrogen and a gestagen is applied every third day. In such therapy, therefore, about 4 plasters have to be used in the first phase, and then about 4 plasters in the second phase.

Thus, the object of the invention is to simplify the administration of these plasters in the intended therapy schedule, and to avoid confusion occurring, by providing a multipack which contains a defined number of planar systems, for example a total of 8 plasters in the respective bags, in the required sequence and joined together in a block.

The object is achieved by a multipack for removing individual bags, wherein the bags have an inner area and an edge enclosing this inner area, wherein at least two bags are joined together to form a block, wherein within this block a section of the edge of a first bag lies almost over the whole surface of the section of the edge of an adjacent second bag, and, wherein within this block, the thereby superposed sections of the edges of the respectively adjacent bags are firmly connected to one another.

This block can additionally be provided with a backing. To protect the bag from contamination and mechanical damage, the backing can be replaced by a re-sealable cover which encases the bags. The cover can additionally be closed with a closure seal so that the person buying the pack can tell whether the pack is still intact. Such a seal is, for example, a sticker which is stuck on two articulated flaps. The materials from which the backing or the cover are made can be paper, paperboard, cardboard, plastic, metal, plastic foil, composite materials such as metal-coated and/or plastic-coated paper, etc.

However, the block itself can also be provided with a closure seal. In this case, such a seal (sticker) is arranged to the side of or opposite the connecting means which firmly connect the superposed sections of the edges of the respectively adjacent bags.

This multipack (so-called calendar pack, ie. the block of several firmly connected bags) can then be packed in a conventional folding carton. In the case of large packs, a plurality of these multipacks can be combined in one folding carton.

If the contents present in the inner area of the bags have a certain thickness, and if the block contains a plurality of bags, these bags can fan out, but this can be avoided by using spacers.

For this purpose, a spacer (see FIG. 6) is inserted in this block between the section of the edge of a first bag and the almost fully overlying section of the edge of an adjacent second bag and then, in this block, the thereby superposed sections of the edges of the respectively adjacent bags and the intermediate spacers (eg. foil made of plastic, paper strips) are firmly connected to one another. The spacers preferably have a thickness which corresponds to the thickness of the contents of a bag. Adapting the thickness of the adhesive layer or adhesive foil is not necessary.

The user (eg. the patient) first removes the multipack from the folding carton. By means of the original seal (ie. the undamaged closure seal), it is possible to tell whether the multipack has already been opened. After opening the seal, the user first removes the uppermost bag since this is the one presented to the user and the easiest to remove. The backing or the cover ensures that the user cannot remove a bag from the back and thus in the incorrect order, i.e. reverse order. On removing the first bag, the joins between the remaining bags are not destroyed and the required sequence is thus retained. The remaining bags are then protected by closing the cover.

The intended sequence of removal of the bags and the sequence of application of the contents (plasters, TTS) are further indicated by providing printed information (eg. numbers date) on the individual bags.

In a particular embodiment, the section of the edge of a first bag is laid over the section of the edge of an adjacent second bag in such a way that the respective margins of these edges are slightly offset in parallel (see FIG. 7). The advantage of this is that that when an adhesive is used as connecting means, the contact surface between adhesive and bag foil is increased and a better hold on the bags is afforded. This also makes it easier to use an adhesive tape as connecting means. The extent of the parallel offset generally depends on the thickness of the bags and in a preferred embodiment this amounts to at least 0.3 mm.

Such multipacks are produced in the following steps:

a) manufacturing the product-filled bags in conventional manner, b) superposing these bags in such a way that the section of the edge of a first bag lies almost over the whole surface of the section of the edge of an adjacent second bag, the subsequent sequence of removal and application being observed, and c) permanently connecting the superposed sections of the edges of the bags.

If appropriate, perforation lines or other predetermined break lines are even punched into the edge of the bag during the manufacture of the product-filled bags.

If appropriate, a backing or cover is also laid under the superposed bags before or after the permanent connection of the superposed sections of the edges.

In a particular embodiment of this production method, after the bags to be permanently connected have been placed over one another, these bags are offset in parallel slightly (preferably by at least about 0.3 mm in each case) so that upon subsequent connection of the superposed sections of the edges of the bags with the aid of adhesives, for example, the contact surface between adhesive and bag is increased.

In another embodiment, the bags of a multipack can hold two different types of contents (eg. two TTS with different active substances or active substance combinations) which have to be removed in a predetermined sequence corresponding to the sequence of the bags within the multipack (from the top toward the backing).

According to the invention, the multipack can be used in a method for transdermal administration of hormones in which, in a first treatment phase, at least one transdermal therapy system (TTS) is administered which contains at least one estrogen, and, in a second treatment phase, at least one transdermal therapy system is administered which contains at least one estrogen and one gestagen. For this purpose, at the start of the first treatment phase, at least one bag containing a transdermal therapy system with at least one estrogen is removed from the multipack and applied to a user's skin and, at the start of the second treatment phase, at least one bag containing a transdermal therapy system with at least one estrogen and one gestagen is removed from said multipack and applied to user's skin.

The actual number of bags in the multipack in this case depends on what period of administration the individual transdermal therapy systems are designed for. If the transdermal therapy systems are plasters, for example, which are intended to be worn by the user for three days, a total number of two times four TTS or two times five TTS is recommended, the number two here relating to the different TTS types (estrogen-containing or estrogen-and gestagen-containing).

Embodiments of the multipack according to the invention are explained with reference to FIGS. 1 through 7:

FIG. 1 shows a basic form of the multipack according to the invention. It comprises a simple backing (1) and the individual bags (2) which are connected to one another at their ends to form a block with the aid of a connecting means (3). Such a connecting means can be, for example, a chemically or physically setting binder, that is to say adhesive, glue, one-sided or double-sided adhesive tape or the combination of such means. Hot-melt adhesives known to the person skilled in the art are preferably used.

FIG. 2 shows a further embodiment of the multipack. Here, the backing is in the form of a cover (4). The cover (4) encloses the individual bags (5). These bags, together with the cover, are connected to one another with the aid of the connecting means (6) to form a block.

In FIG. 3, the multipack is illustrated with a cover (4) in the opened state. The uppermost bag (7) can be removed from the front, without in so doing destroying the block of other bags (5).

FIGS. 4 and 5 illustrate a further embodiment of the multipack. Here, the bags (11, 12) have an additional edge (9) separated by a perforation line (10). The bags (11, 12) are connected to the backing (8) in the area of this edge (9) to form a block. This can be done in a known manner, inter alia by adhesive bonding, gluing, sealing or stapling. To remove the respective upper bag (12), the latter is separated at the perforation line (10). The perforation edge (9) of the removed bag remains firmly connected to the respective edges of the other bags (11 in FIG. 5) of the block.

FIG. 6 shows an embodiment in which spacers (13) lie between the almost fully superposed sections of the edges (9) of adjacent bags (5).

FIG. 7 shows an embodiment in which the respective margins of the edges (9) of the individual adjacent bags (5) are offset in parallel in the direction of the opposite edges.

What is claimed is:

1. A method for transdermal administration of hormones to a patient involving a multipack comprising at least two individual bags that are joined together to form a block, wherein each individual bag comprises an inner area, which contains a transdermal therapy system (TTS), each individual bag possesses an edge that encloses the inner area, the individual bags are arranged in a predetermined sequence, and whereas within said block, an edge section of a first bag lies almost over the edge section of a second adjacent bag, thereby superimposing the edge sections of the two adjacent bags, the superimposed edge sections of the two adjacent bags are offset with respect to each other, and the superimposed edge sections of the respectively adjacent bags are connected to one another, wherein the sequence of said bags in said block corresponds to the predetermined sequence of removal, said method comprising of a first treatment phase and a second treatment phase, where in said first treatment phase at least one transdermal therapy system (TTS) containing at least one estrogen is administered to the patient, and where in said second treatment phase at least one transdermal therapy system containing at least one estrogen and one gestagen is administered to the patient, wherein, at the start of the first treatment phase, at least one bag containing a transdermal therapy system with at least one estrogen is removed from the multipack and the transdermal therapy system contained therein is applied to the patient's skin, and at the start of the second treatment phase, at least one bag containing a transdermal therapy system with at least one estrogen and one gestagen is removed for said multipack and the transdermal therapy system containing therein is applied to the patient's skin.

2. A method according to claim 1 wherein the multipack contains a defined number of different transdermal therapy systems in individual bags.

3. A method according to claim 1 wherein said multipack contains about four transdermal therapy systems to be used in the first treatment phase and about four transdermal therapy systems to be used in the second treatment phase.

4. A method according to claim 1 wherein said first treatment phase lasts about 14 days and said second treatment phase lasts about 14 days.

5. A method according to claim 1 wherein the transdermal administration of hormones is used within a hormone replacement therapy.

6. A method according to claim 1 wherein the uppermost bag is removed from the multipack.

7. A method according to claim 1 wherein the bags are removed in the sequence of application of the transdermal therapy systems.

8. A method according to claim 1 wherein the individual bags are provided with printed information indicating the sequence of removal.

* * * * *